US009061324B2

(12) United States Patent
Bamford

(10) Patent No.: US 9,061,324 B2
(45) Date of Patent: Jun. 23, 2015

(54) PIPE CLEANING TOOL

(75) Inventor: Brad Bamford, Scarborough (CA)

(73) Assignee: Automatic Coating Limited, Toronto (CA)

( * ) Notice: Subject to any disclaimer, the term of this patent is extended or adjusted under 35 U.S.C. 154(b) by 1213 days.

(21) Appl. No.: 12/852,157

(22) Filed: Aug. 6, 2010

(65) Prior Publication Data

US 2011/0030740 A1 Feb. 10, 2011

Related U.S. Application Data

(60) Provisional application No. 61/231,841, filed on Aug. 6, 2009.

(51) Int. Cl.

| | |
|---|---|
| ***B08B 7/00*** | (2006.01) |
| ***B08B 9/023*** | (2006.01) |
| ***B08B 3/02*** | (2006.01) |
| ***B08B 15/04*** | (2006.01) |

(52) U.S. Cl.

CPC ..... *B08B 9/023* (2013.01); *B08B 3/024* (2013.01); *B08B 15/04* (2013.01)

(58) Field of Classification Search

CPC ..... B08B 3/024; B08B 15/04; B08B 9/023

USPC ..... 134/115 R, 115 G, 167 C, 168 C, 169 C

See application file for complete search history.

(56) References Cited

U.S. PATENT DOCUMENTS

| | | | | |
|---|---|---|---|---|
| 4,522,242 | A * | 6/1985 | Hutson | 144/208.8 |
| 4,600,444 | A * | 7/1986 | Miner | 134/8 |
| 4,609,019 | A * | 9/1986 | Hutson | 144/208.8 |
| 4,609,020 | A * | 9/1986 | Hutson | 144/208.8 |
| 5,238,331 | A | 8/1993 | Chapman | |
| 5,474,097 | A * | 12/1995 | Lowe et al. | 134/104.4 |
| 6,832,406 | B1 | 12/2004 | Boos et al. | |
| 7,140,065 | B2 | 11/2006 | Boos et al. | |
| 2007/0079469 | A1* | 4/2007 | Cunningham | 15/319 |
| 2008/0023050 | A1* | 1/2008 | Hancock | 134/99.2 |

* cited by examiner

*Primary Examiner* — Michael Barr
*Assistant Examiner* — Benjamin L Osterhout
(74) *Attorney, Agent, or Firm* — Blake, Cassels & Graydon LLP; John R. S. Orange

(57) ABSTRACT

A pipe cleaning device has a housing movable along a pipe to remove a coating. A stripper head, preferably water jets, are located in the housing to remove the coating from the pipe. The coating is removed from the housing by a vacuum hose and a comminution device is located in the housing to reduce the size of the stripped coating and facilitates passage along the hose. The comminution device includes a rotor driven by an external motor and aligned with the axis of the hose.

12 Claims, 9 Drawing Sheets

PIPE CLEANING TOOL

CROSS REFERENCE TO RELATED APPLICATIONS

This application claims priority from U.S. Provisional Application No. 61/231,841 filed on Aug. 6, 2009; the contents of which are incorporated herein by reference.

FIELD OF THE INVENTION

This invention relates, generally, to pipeline surface preparation systems. More particularly, it relates to machines that travel along the length of a pipeline and remove coating therefrom by the application of water jets at ultra high pressure.

DESCRIPTION OF THE PRIOR ART

Pipelines used to carry materials such as oil, gas and water are usually coated on their exterior surface to inhibit corrosion of the pipe material. As part of the maintenance protocol, it is necessary periodically to remove the coating and prepare the surface for recoating.

Pipelines are typically buried and removal of the coating requires the pipeline to be excavated and lifted to allow access to the pipe. Machines have been proposed that are intended to be supported on and move along the pipe to remove the coating. However, earlier devices are so heavy that a crane is needed to lower them into position atop a pipe. The weight of such devices causes the pipe to sag and thus limits the length of pipeline that can be excavated at any one time. When a crane drops a heavy pipeline surface preparation systems onto a pipeline, there is a risk of damage and ultimately catastrophic explosions may occur.

U.S. Pat. No. 5,238,331 to Chapman describes a pipeline surface preparation system that is sufficiently light-in-weight to enable a team of two workers to place it into position around a pipeline in the absence of weight-lifting machinery. A frame surrounds the pipeline and supports wheels that engage the surface of the pipeline and enable the pipeline surface preparation system to travel along the extent thereof. The Chapman apparatus employs water jets to strip coating from a pipeline. Water nozzles are circumferentially spaced about the perimeter of the pipeline and limit switches are employed to cause the frame that carries the nozzles to reciprocate along a circumferential path of travel so that hoses connected to the apparatus are not wrapped around the pipeline as the apparatus advances along the length thereof.

The debris generated by the pipe coating removal process requires careful handling. Old coating commonly includes asbestos and other materials that require special handling. However, the pipeline surface preparation system shown in Chapman does not adequately address the debris-handling problem. The conventional wisdom is that Visqueen® plastic or other suitable sheet material should be placed in overlying relation to the ground below the pipeline undergoing reconditioning. Asbestos and other debris is thus collected atop the plastic sheet material as the machine travels along the extent of the pipeline. Workers then carefully fold the plastic sheet material in an attempt to contain the hazardous materials deposited. The inadequacies of this well-known procedure are readily apparent. Asbestos in small pieces may easily float in the air beyond the reaches of the plastic sheet material and enter the lungs of workers in the vicinity. Asbestos may also enter the lungs of those who attempt to collect it by folding the plastic sheet material into a collection means.

U.S. Pat. No. 6,832,406 to Boos describes a machine that addresses a number of these problems by enclosing the pipe within a shroud. Debris removed from the pipe surface is removed from the shroud by a vacuum line so it may be filtered and disposed of effectively. The machine shown in U.S. Pat. No. 6,832,406 has been used commercially with success. The arrangement of water nozzles and controls avoids the potential damage to the pipe surface if the machine encounters unforeseen obstacles and the overall design allows the machine to be positioned on the pipeline by workers and operate within the confines of the excavation.

The water jet action used in the Boos machine is intended to produce relatively small particles so that the asbestos can be controlled. However, the nature of the coating is such that large pieces may be removed due to the lack of adhesion of the coating to the pipe. The presence of these pieces within the shroud inhibits the operation of the machine and requires human intervention to remove them once detected.

It is known to provide an external shredding means to reduce the debris particles to a more manageable size. The price of an external shredder increases the cost of the system, the time required to operate the external shredder decreases productivity, and the operation of the shredder could potentially add to environmental concerns with hazardous wastes. Moreover, such a shredder is only effective after the particles have been removed from the shroud.

SUMMARY OF THE INVENTION

The novel structure includes a vacuum shroud having a main wall that surrounds a longitudinally-extending section of a pipeline. The vacuum shroud has end walls that are apertured to receive the pipeline. A plurality of equidistantly and circumferentially spaced apart nozzle openings are formed in the main wall and an ultra high pressure water nozzle is positioned within each of the nozzle openings.

A carrier assembly causes the vacuum shroud to travel along the extent of the pipeline in a predetermined direction. An oscillating means oscillates the vacuum shroud in a first rotational direction and in a second rotational direction opposite to the first rotational direction as the vacuum shroud travels along the pipeline.

A vacuum opening is formed in the vacuum shroud at a lowermost end thereof. A vacuum hose has a leading end connected to the vacuum opening and a trailing end adapted to be connected to a remote source of negative pressure. A filter trap disposed between the vacuum opening and the remote source of negative pressure collects debris stripped from the pipeline. Accordingly, debris collected within the filter trap is not discharged into the atmosphere.

The main wall of the vacuum shroud has a cylindrical main body and a wedge-shaped lower body formed integrally therewith. The lower body has a lowermost point positioned coincident with a vertical plane that bisects the pipeline when the machine is in a position of equilibrium so that debris created when said coating is stripped from the pipeline falls under the influence of gravity into the wedge-shaped lower body.

A comminution device is incorporated within the wedge shaped lower body so that coating must pass through the device to the vacuum opening.

Preferably the comminution device extends parallel to the axis of the pipeline between the end walls of the shroud. As a further preference the device is driven by a motor external to the housing that is either pneumatically or hydraulically driven.

BRIEF DESCRIPTION OF THE DRAWINGS

The features of the invention will become more apparent in the following detailed description in which reference is made to the appended drawings wherein.

DETAILED DESCRIPTION OF THE INVENTION

Figure 1:
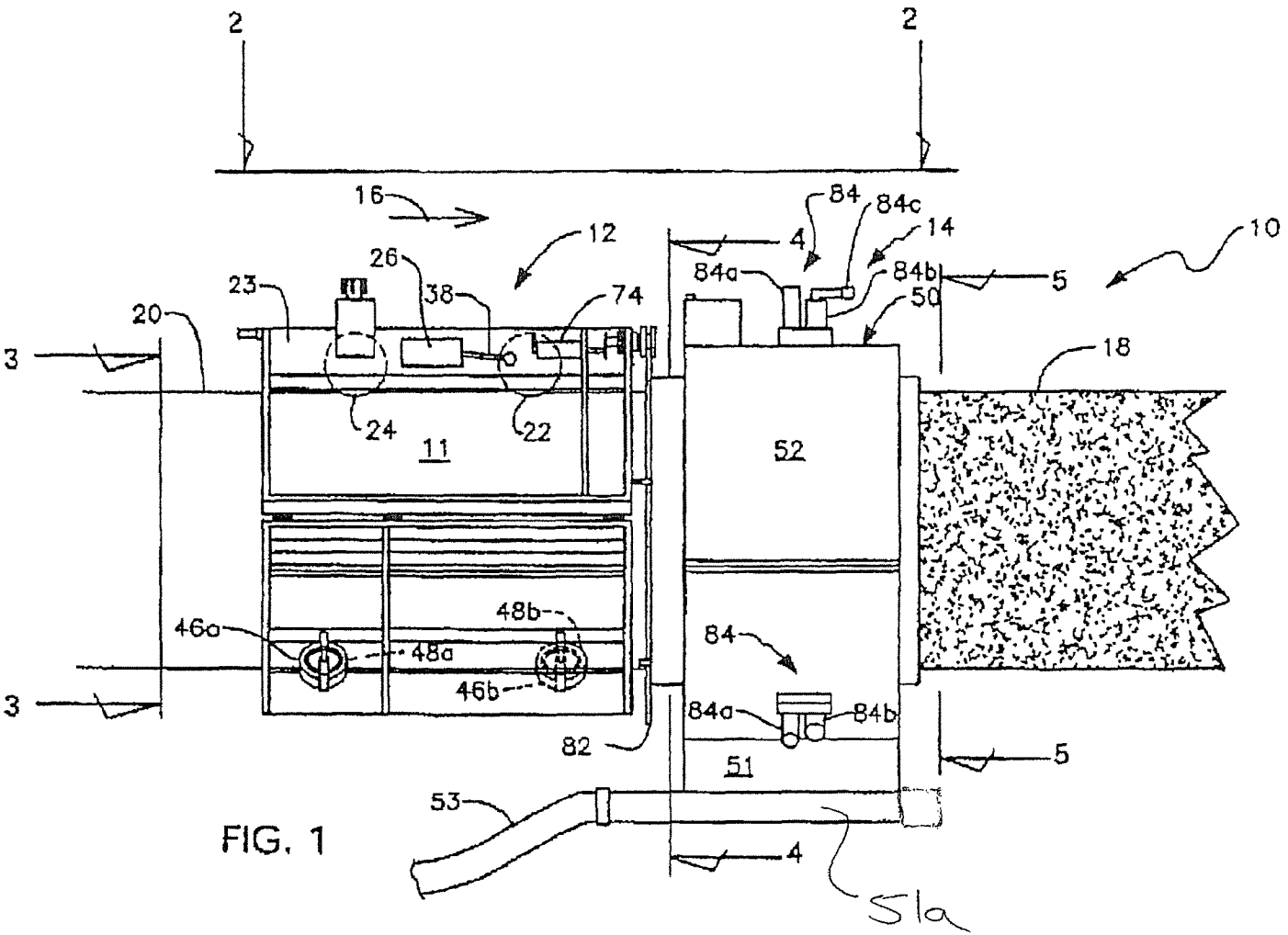
FIG. 1 is a side elevational view of a pipeline surface preparation system.

Referring now to FIG. 1, a pipeline surface preparation machine 10 has two primary parts, namely a carrier 12 and a stripping head 14. The carrier 12 performs the function of advancing machine 10 along the extent of pipeline 11. The stripping head 14 performs the function of removing coating from the pipeline 11.

In FIG. 1, the direction of travel of machine 10 is denoted by directional arrow 16. Pipe coating to be removed is denoted 18 and surface of the pipe from which the coating has been removed is denoted 20.

Carrier 12 has an open frame construction as depicted so that it is light-in-weight. Carrier 12 contains all major mechanical, electrical, hydraulic, and pneumatic components and controllers. If any part of the assembly fails, the entire drive system can be quickly replaced and subsequently repaired off-line. It is standard to a number of pipe sizes so a spare may always be available.

Figure 2:
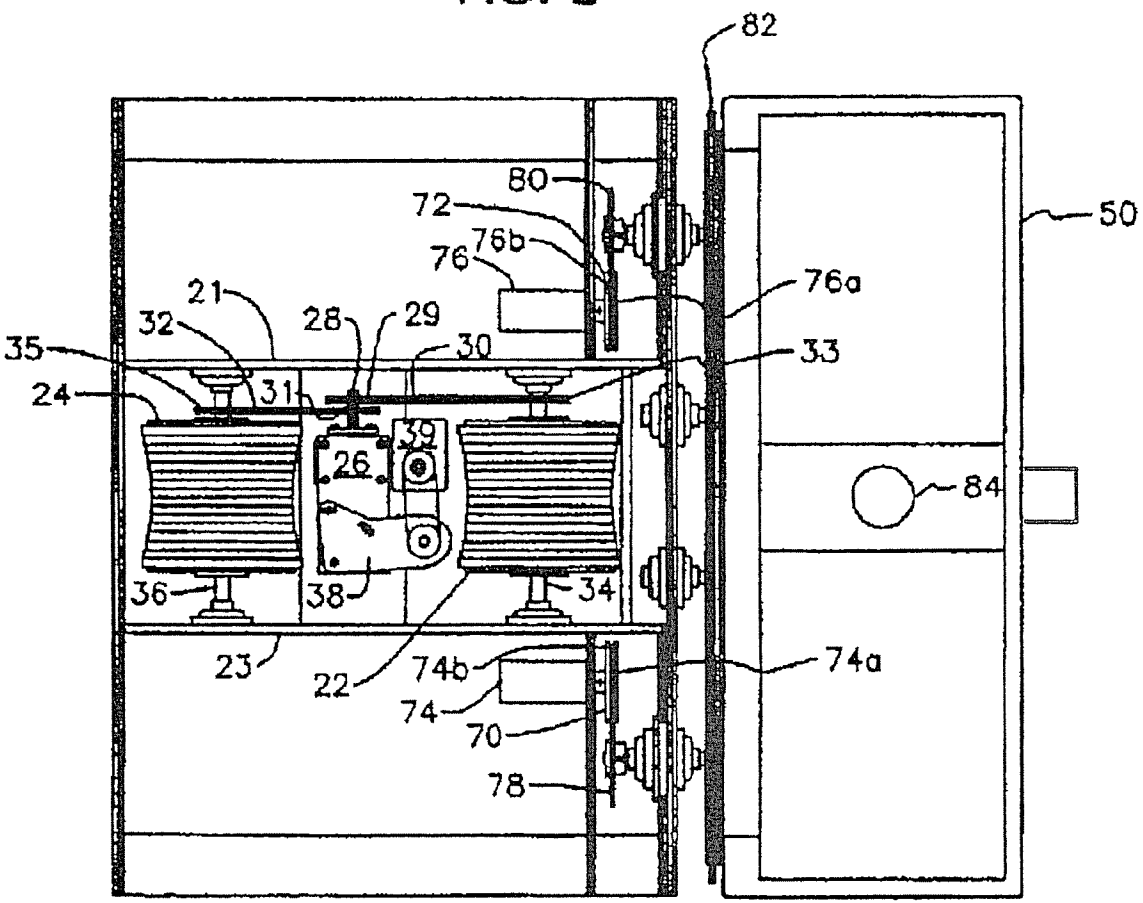
FIG. 2 is a top plan view taken along line 2-2 in FIG. 1.
Figure 8:
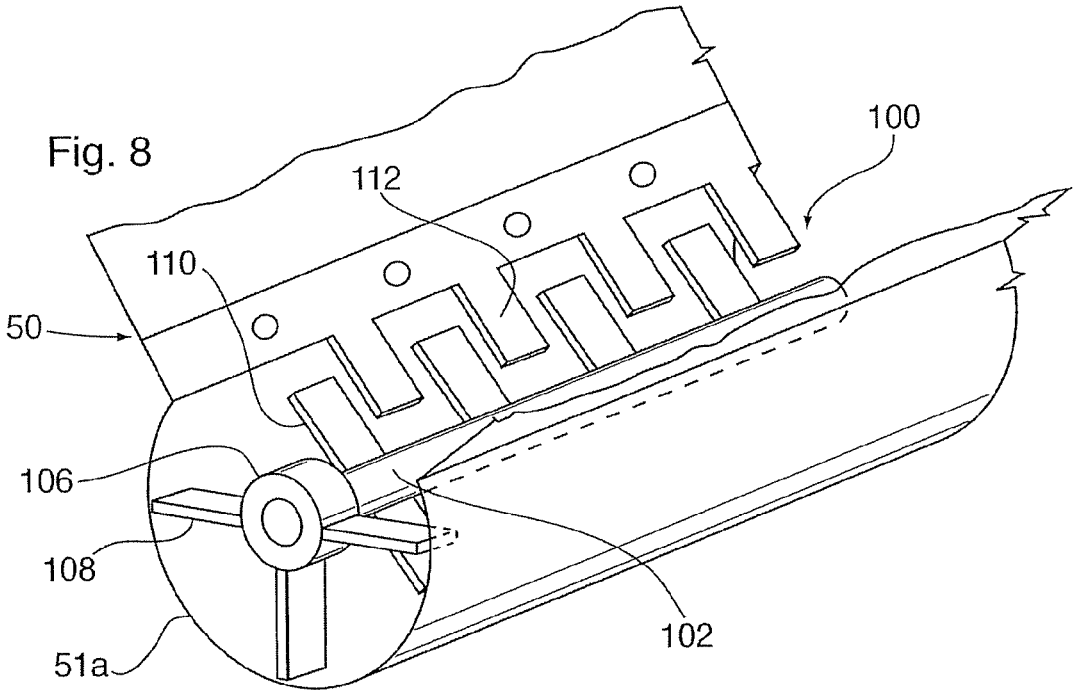
FIG. 8 is an enlarged perspective view of a portion of the shroud of FIG. 6.

As best understood in connection with FIG. 2, leading drive wheel 22 and trailing drive wheel 24 are rotatably mounted on axles having their opposite ends supported by mounting plates 21, 23, respectively, that form a part of the frame assembly. Drive wheels 22, 24 are in longitudinal alignment with one another and are typically of rubber construction. Each of said drive wheels is contoured as depicted in FIGS. 2 and 8. The concave curvature of each wheel matches the convex curvature of the pipeline to enhance the traction between the wheels and the pipeline. Moreover, the surface of each wheel has a saw tooth or gear tooth tread to further enhance the traction. Wheels 22, 24 drive the machine 10 at a controlled constant rate of forward speed along the pipeline. Machine 10 is driven by wheels 22, 24 up inclines as steep as fifty degrees or down declines of the same degree. Carrier 12 will also follow long radius pipeline curves.

Wheels 22, 24 prevent rotational slippage of carrier assembly 12 relative to pipeline 11. This ensures that pipe stripped of its coating will not be impinged by a stationary jet for extended periods.

As perhaps best understood in connection with FIG. 2, wheels 22 and 24 are driven by hydraulic motor 26 although electrical or mechanical drives may be used if preferred. More particularly, output shaft 28 is connected in driving relation to gears 29, 31 that drive belts 30, 32, respectively. Belts 30, 32 drive gears 33, 35 that are mounted on axles 34, 36 upon which drive wheels 22, 24 are mounted, respectively.

Control lever 38 is connected as depicted to gearbox 39 and enables an operator to place motor 26 into forward, stop or reverse.

Figure 3:
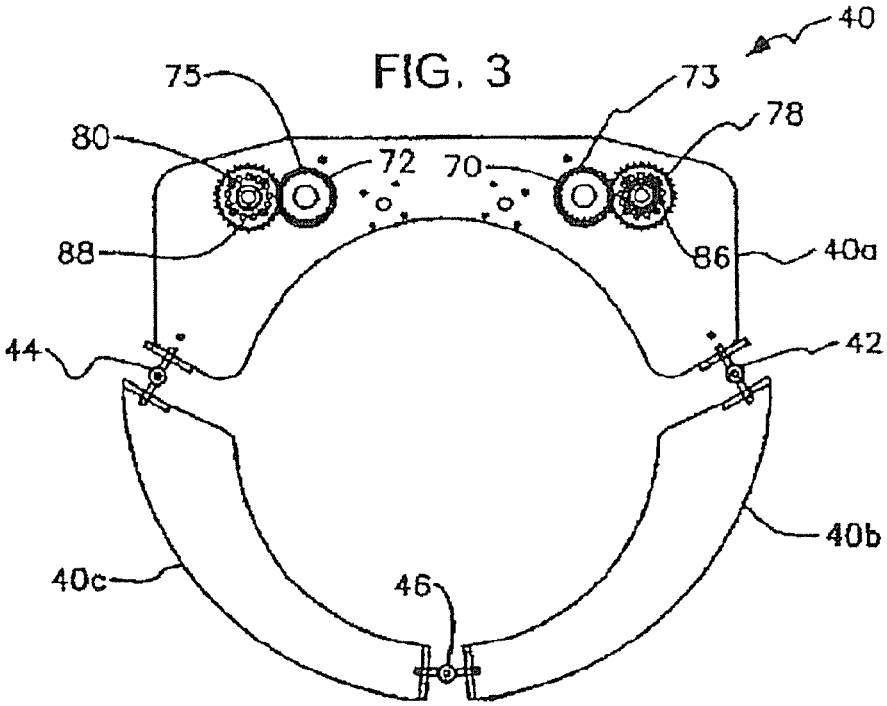
FIG. 3 is an end view taken along line 3-3 in FIG. 1.

As best understood in connection with FIG. 3, frame 40 includes a top part 40*a*, first bottom part 40*b*, and second bottom part 40*c*. Each of said parts has a frame-like construction so that it is light-in-weight. Top part 40*a* is positioned above the pipe in spaced relation thereto. First side part 40*b* is releasably connected to a first end of top part 40*a* by quick-release coupling means 42 and second side part 40*c* is releasably connected to a second end of top part 40*a* by quick-release coupling means 44. First and second side parts 40*b*, 40*c* are releasably connected to one another by quick-release coupling means 46. Two workers lift top part 40*a* into position. Workers standing on opposite sides of the pipeline then engage first and second parts 40*b* and 40*c* thereto and to one another.

Wheels 46*a* and 46*b* (FIG. 1) are circumferentially spaced one hundred twenty degrees from drive wheels 22, 24 and are on opposite sides of carrier 12. Wheels 48*a* and 48*b* of the same construction are also circumferentially spaced one hundred twenty degrees from drive wheels 22, 24 and the same number of degrees from wheel 46*a*, 46*b* and are also on opposite sides of carrier 12. Wheels 46*a*, 46*b* and 48*a*, 48*b* are mechanically compressed against cleaned surface 20 and cooperate with drive wheels 22, 24 to maintain the frame of driving apparatus 12 in concentric alignment with the pipeline. Wheels 46*a*, 46*b*, 48*a*, and 48*b* are passive, however, and do not provide any motive force to the travel of driving apparatus 12 along the extent of the pipeline.

Figure 4:
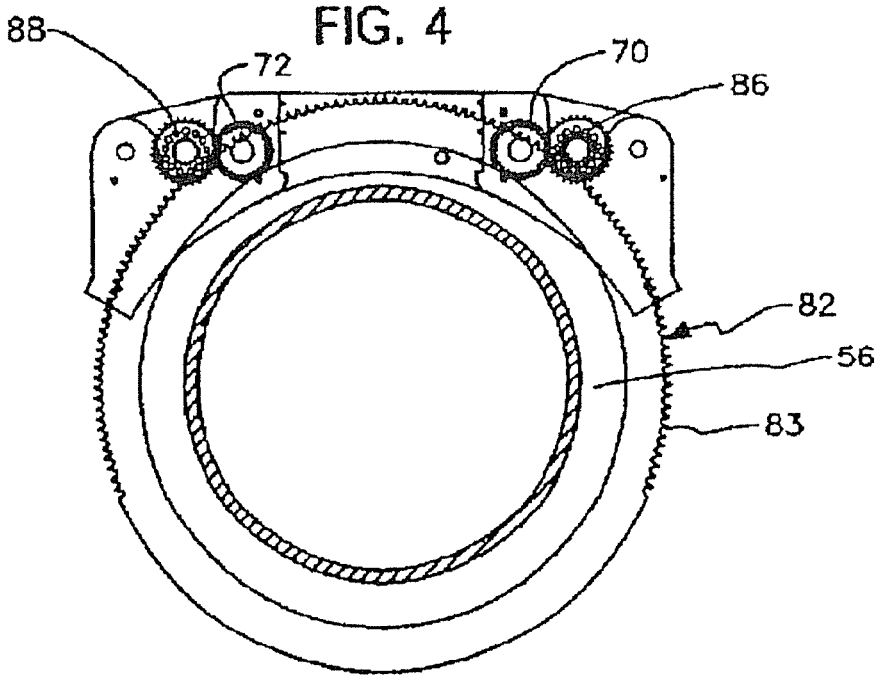
FIG. 4 is a sectional view taken along line 4-4 in FIG. 1.
Figure 5:
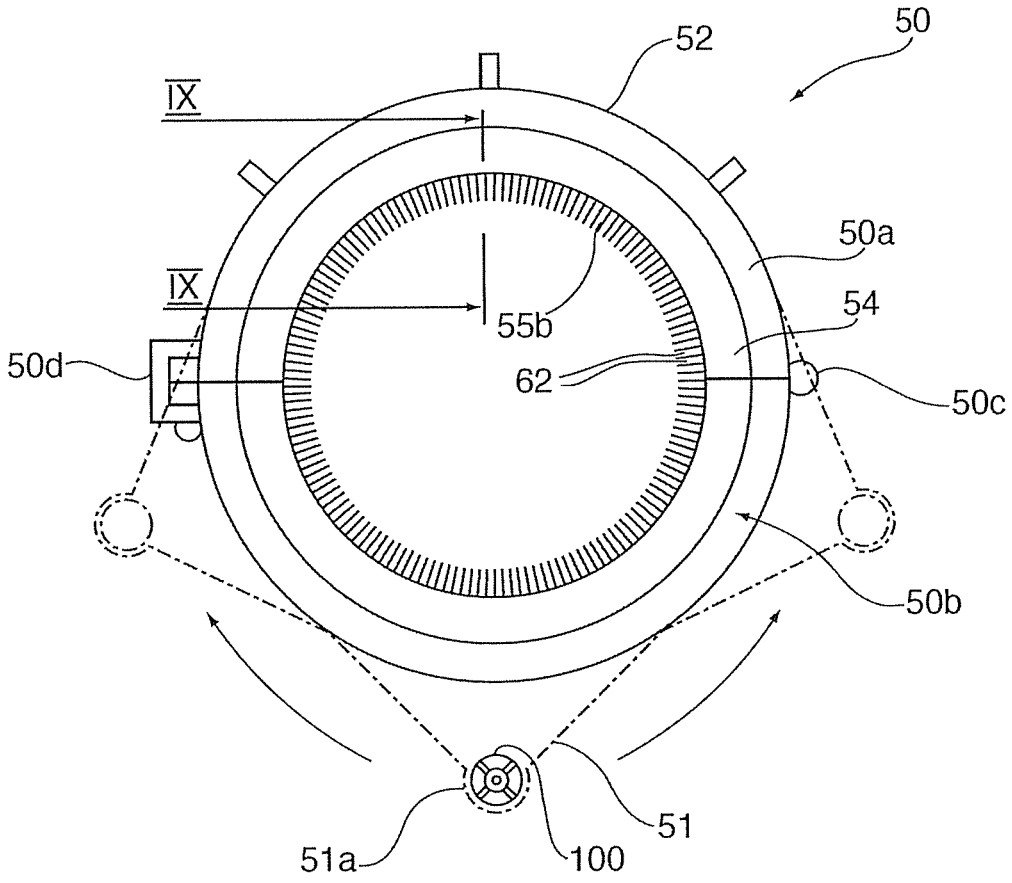
FIG. 5 is a sectional view taken along line 5-5 in FIG. 1.

The stripping head 14 includes vacuum shroud 50 that circumscribes pipeline 11 in advance of the carrier 12. Vacuum shroud 50 includes a first cylindrical wall 52 that circumscribes pipeline 11 and a pair of centrally apertured end walls. End wall 54 is depicted in FIG. 5 and end wall 56 is depicted in FIG. 4. The shroud 50 is formed in two parts 50*a*, 50*b* that are hinged to one another by a hinge 50*c*. The parts 50*a*, 50*b* are connected by a quick release fastener 50*d* with seals between the two parts to maintain the integrity of the shroud 50. The shroud 50 may therefore be opened, placed on the pipeline 11 and secured to encompass the pipeline.

As best understood in connection with FIGS. 1 and 5, a wedge-shaped debris collection chamber 51 is integrally formed with vacuum shroud 50 at its lowermost end. Vacuum hose 53 has a trailing end, not shown, in fluid communication with a remote source of negative pressure. The leading end of said vacuum hose 53 is in fluid communication with a cylindrical trough 51*a* located at the apex of the wedge-shaped debris collection chamber 51 as depicted to provide a material handling system to remove debris from the collection chamber 51. It should be understood that the hollow interior of vacuum shroud 50 and the hollow interior of wedge-shaped debris collection chamber 51 are in open communication with one another. Debris created by removal of the pipe coating thus falls under the influence of gravity into debris collection chamber 51 and into trough 51*a*.

As will be better understood as this description proceeds, the ultra high pressure and unique nozzle movement of the machine shreds the debris created by removal of the pipe coating into particles that are typically no larger than a quarter inch in diameter.

Figure 6:
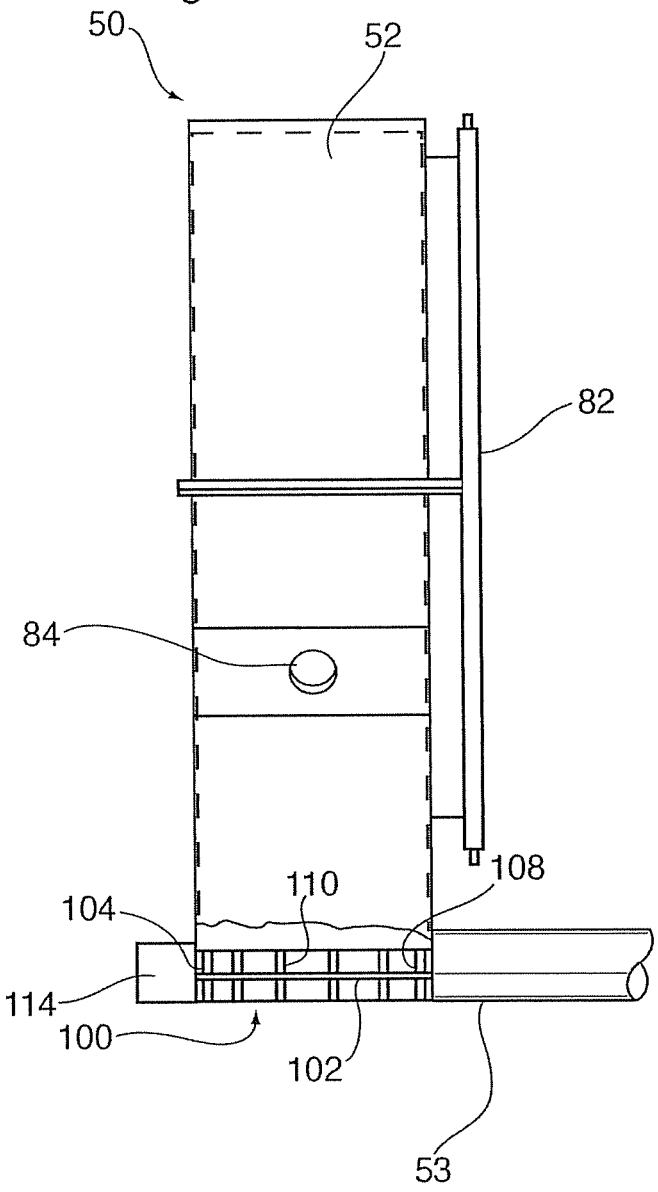
FIG. 6 is a side elevational view of a vacuum shroud.
Figure 7:
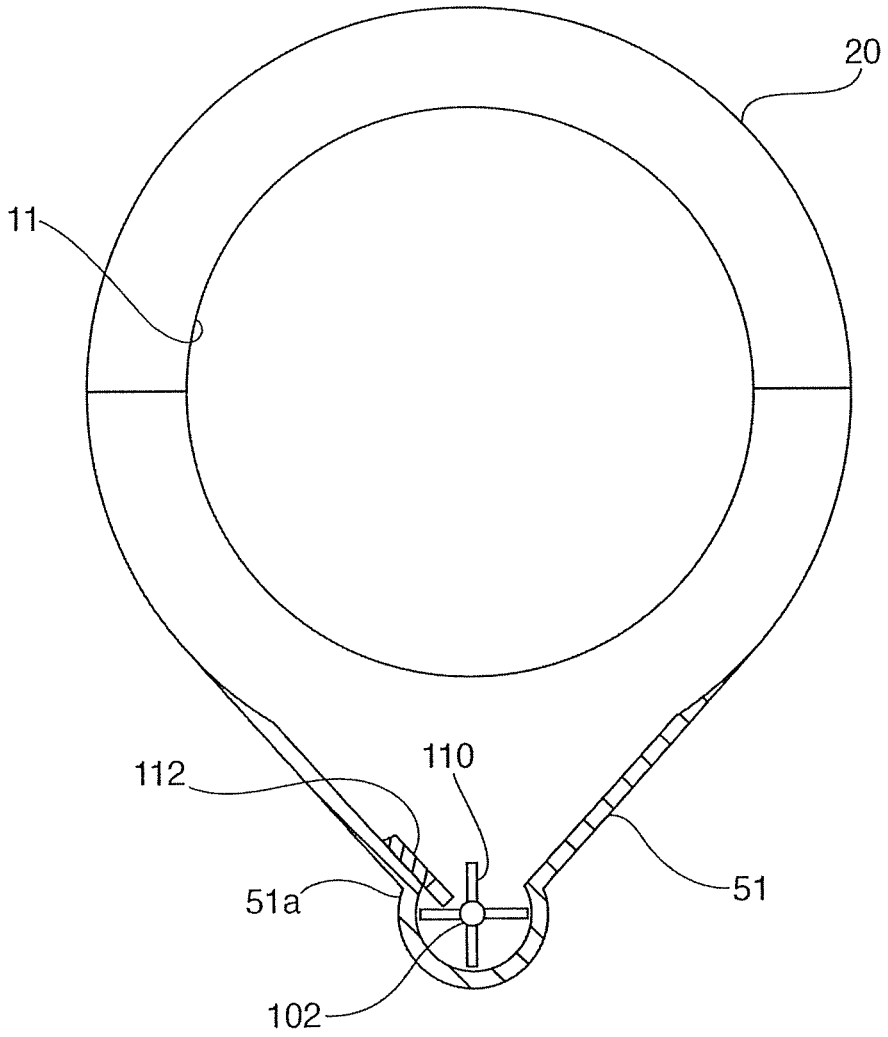
FIG. 7 is an end view partly in section of the vacuum shroud.

A comminution device 100 is located within the trough 51*a* of the housing 50 to ensure that coating 18 is below a particular size so it may be handled by the material handling system. As can be seen in FIGS. 6 to 8, the comminuting device 100 includes a shaft 102 that is rotably mounted in the housing 50 on bearings 104, 106 for rotation about a axis parallel to the pipeline 11. The bearing 106 adjacent outlet 53 is supported on a spider 108 to provide clearance for material to flow to the outlet 53.

A plurality of fingers 110 extend radially from the shaft 102 and into close proximity to the wall of a cylindrical trough 51*a* of the wedge shaped portion 51. The fingers 110 pass between stationary fingers 112 mounted on the housing 51 and extending toward the shaft 102.

The interdigitated fingers 110, 112 are axially spaced approximately the maximum size of particle that can be accommodated in the outlet 53.

A motor 114 is mounted on the exterior of the end wall 55 and drives the shaft 102, either directly or through a gear train or chain drive. The motor 114 may be electrical, pneumatic or hydraulic, depending on the services available.

Figure 9:
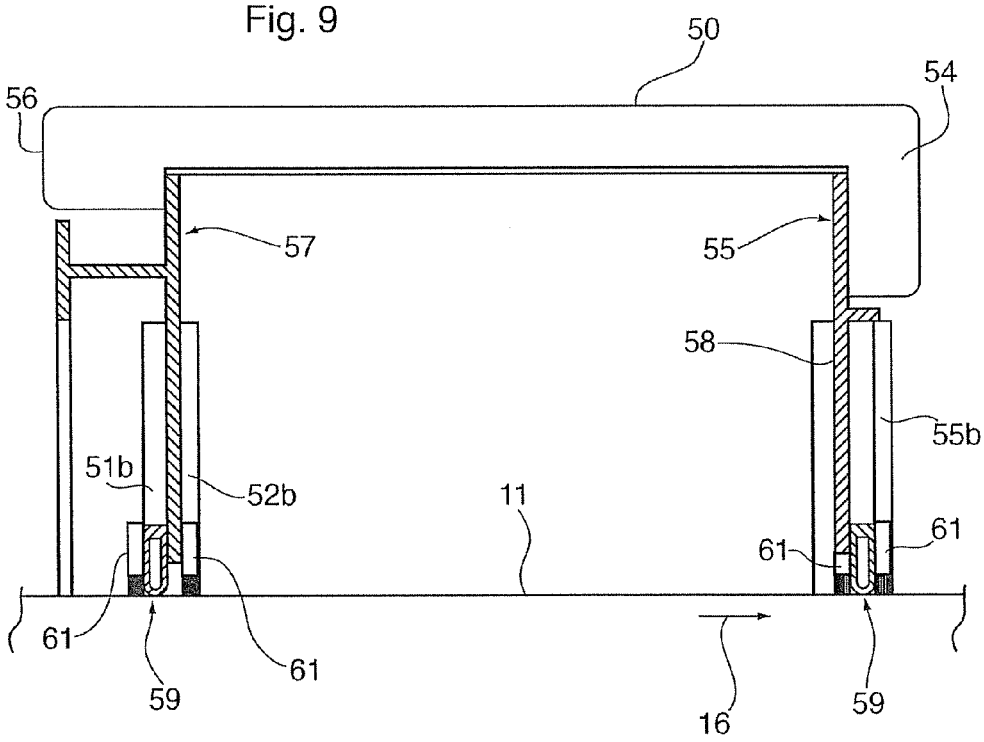
FIG. 9 is a sectional view on the line IX-IX of FIG. 5.
Figure 10:
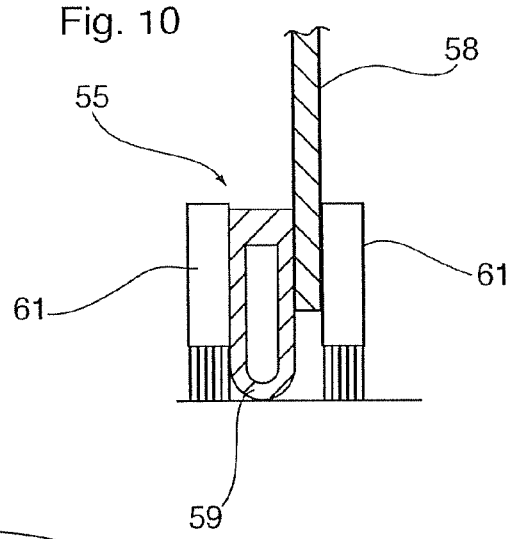
FIG. 10 is an enlarged view of a seal system shown in FIG. 9.

FIGS. 9 and 10 provide an interior view of vacuum shroud 50. The shroud 50 is sealed against the pipeline 11 by seal assemblies 55, 57 and is secured to an interior surface of leading shroud end wall 54 and trailing shroud end wall 56 respectively.

Each of the seal assemblies 55, 57 is similar and therefore only one will be described in detail.

A radial wall 58 extends toward the pipeline 11 and carries on inflatable seal 59 at its radially inner end. Each of the seals 59 is semi circular so as to extend around the radially inner edges of each half of the shroud 50*a*, 50*b*. The seal 59 bears against the pipeline 11 and is inflated to provide a positive contact for the seal against the pipeline 11.

A pair of brushes, 61, are mounted on opposite sides of the seal 59 to further inhibit egress of material from the shroud.

The inflatable seals 59 deform to accommodate irregularities on the surface of the pipeline 11 as the shroud rotates and advances alone the pipeline 11.

The seal assemblies 55, 57 maintain water vapor and debris emissions such as asbestos, lead, and other hazardous materials, at levels well below exposure limits established by the Occupational Safety and Health Administration while maintaining the vacuum within shroud 50 as already mentioned. The waste generated by the cleaning process is then recycled through a closed loop filtration system that separates solids from reusable liquid, thereby substantially reducing the quantity of disposable waste.

The oscillation of vacuum shroud 50, relative to the longitudinal axis of pipeline 11, as it advances along the length of pipeline 11 is best understood in connection with FIG. 5. The position of repose or top center of vacuum shroud 50 is indicated in solid lines and dotted lines indicate its respective positions when at the limits of its oscillation. When in its position of repose, a vertical plane passes through first limit switch actuator 50*a* and through the lowermost point of debris collection chamber 51. Carrier assembly 12 does not oscillate.

As best understood in connection with FIGS. 2-4, gear 70 and 72 are connected to the respective outputs shafts of motors 74, 76, respectively secured to the carrier 12. Gear assemblies 70, 72 include a plurality of circumferentially spur gears 73, 75 (FIG. 3) respectively, that are connected to the output shafts 74*a* and 76*a* of motors 74, 76 and mesh with sprocket teeth formed on sprocket gears 78, 80.

A large ring 82 (FIG. 4) is fixedly secured to the trailing end of vacuum shroud 50 as depicted in FIGS. 1 and 2 and has teeth 83 formed therein along about two hundred forty degrees) (240°) of its circumferential extent. Teeth 83 mesh with sprockets 86, 88 (FIG. 4) that form a part of gears 78, 80 (FIG. 3). Motors 74, 76 effect rotation of gear assemblies 70 and 72 which drive gears 78 and 80 and thus effect rotation of large ring 82. A pair of limit switches are mounted on non-oscillating carrier assembly 12 in positions of sixty five degrees (65°) from either side of top center. Accordingly, as large ring gear 82 is rotated by motors 74, 76 in the manner described above, the large ring gear rotates until limit switch actuator 50*a* (FIG. 5) contacts first limit switch 50*b*. Limit switch 50*b*, upon being thrown by said contact, sends a signal that reverses the direction of operation of motors 74, 76 so that large ring gear 82 begins rotating in an opposite direction. The gear 82 then rotates in the opposite direction until limit switch actuator 50*a* contacts second limit switch 50*c* and said second limit switch sends a signal that reverses said motors 74, 76. An oscillation cycle of one hundred thirty degrees (130.degree.) is thereby attained. Such oscillation of large ring gear 82 and hence of vacuum shroud 50 to which said ring gear is secured continues for as long as machine 10 is in operation. The rocking motion of vacuum shroud 50 further serves to facilitate collection of debris within said debris collection chamber.

The combination of linear travel and oscillatory motion of vacuum shroud 50 further ensures against the creation of hot spots, resulting from stationary positioning of the shroud.

In a preferred embodiment a stripping head to remove water from the pipe comprises, three ultra high pressure water manifolds are mounted on vacuum shroud 50 in circumferentially and equidistantly spaced relation to one another. Thus, the manifolds are spaced about one hundred twenty degrees (120 degree.) apart from one another. Two of the manifolds are visible in the side view of FIG. 1 and said manifolds are collectively denoted 84. Hose 84*a* delivers ultra high pressure (40,000 lbs/in$^2$) water or other suitable liquid fluid and hose 84*b* delivers air at a suitable pressure to drive air motors which in turn rotate the nozzles. Element 84*c* is an electrical sensor in electrical communication with a programmable logic controller that shuts down the ultra high pressure nozzle flow if nozzle movement stops or the system air pressure drops. Similar sensors monitor the forward advance of carrier assembly 12 and the oscillation of vacuum shroud 50 and shut down the system if either of the motions stop. This fail-safe control eliminates potential pipeline or surface damage caused by extended nozzle dwell time.

Each manifold 84 includes four or five individual sapphire nozzles, each of which spins at three thousand revolutions per minute (3,000 rpm). This provides a uniform spray pattern over a two inch (2") or so diameter area. This manifold of spinning nozzles provides a uniformly cleaned surface that is free of hot spots and surface damage.

Mounting manifolds 84 in vacuum shroud 50 also ensures that the distance between each nozzle and the surface of the pipeline will always be a uniform distance and thereby produce a uniform effect on the surface of pipe 11.

The effect of the nozzles 84 is to remove the coating in relatively small pieces with the fibrous materials contained within a slurry. However, there is a tendency for some of the coating 18 to flake off as larger pieces that become lodged in the lower portion of the housing 50.

Relatively small pieces of coating will fall between the fingers 110, 112 as the housing 50 oscillates and pass freely to the outlet 53. Larger pieces that may flake off do not pass between the fingers 110 and are carried by the fingers 110 into contact with the fingers 112. The flakes are broken into smaller pieces through the interaction of the fingers 110, 112, allowing them to pass through the outlet 53.

Figure 11:
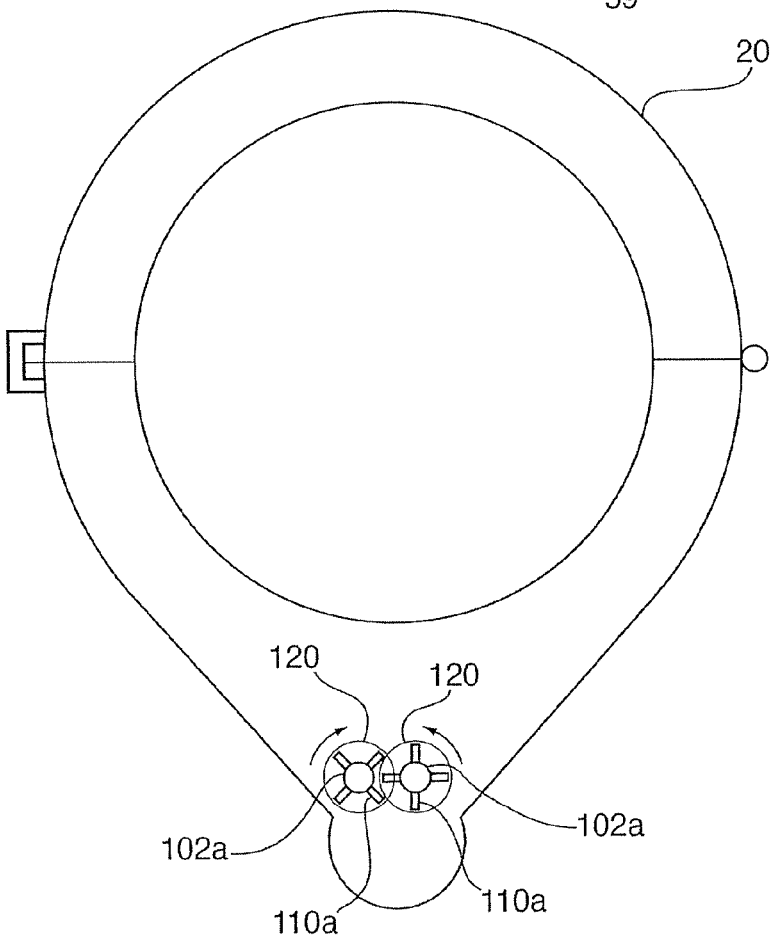
FIG. 11 is a view similar to FIG. 8 of an alternative embodiment.

An alternative embodiment is shown in FIG. 11 where like components will be identified by like reference numerals with a suffix 'a' added for clarity. In the embodiment of FIG. 11, a pair of shafts 102*a* are mounted between the end walls 55*a*, 57*a* adjacent to but spaced from the outlet 53*a*. Each of the shafts 102*a* carries radially extending fingers 110*a* that interdigitate.

The shafts 102*a* are connected by spur gears 120 and a motor 114 drives one of the shafts 102*a*. Rotation of one of the shafts is transmitted to the other shaft through the gears 120 so that the shafts 102*a* counter rotate.

In operation, as larger pieces fall toward the outlet 53*a*, the fingers 102*a* interact to break them into smaller pieces that can be handled by the outlet 53*a*.

In either embodiment, the comminution device 100 reduces the size of the removed coating to avoid blockage.

I claim:

1. A pipe cleaning device comprising a housing to encompass a pipe to be cleaned and rotatable relative thereto, a drive to impart oscillatory rotation to said housing relative to said pipe, at least one stripping head within said housing and operable to remove a coating from said pipe, drive members to move said housing along said pipe, and a material handling system to remove material from said housing, said material handling system including a comminution device to reduce fragments of coating removed from said pipe and ensure coating removed from said pipe may be handled by said material handling system.

2. A pipe cleaning device according to claim 1 wherein said material handling system includes a hose connected to said housing and connectible to a source of negative pressure to induce flow from said housing.

3. A pipe cleaning device according to claim 2 wherein said housing has a collection area adjacent to said hose and said comminution device is located at said collection area.

4. A pipe cleaning device according to claim 3 wherein said collection area is a trough aligned with said hose and said comminution device is located within said trough.

5. A pipe cleaning device according to claim 4 wherein said comminution device includes a rotor driven by a motor.

6. A pipe cleaning device according to claim 5 wherein said rotor includes fingers engagable with said material.

7. A pipe cleaning device according to claim 6 wherein said fingers cooperate with stationary fingers to reduce the size of coating entering said hose.

8. A pipe cleaning device according to claim 6 wherein said comminution device includes a pair of counter-rotating rotors, each of said rotors having fingers, with said fingers interdigitated to comminute said coating material as said rotors rotate.

9. A pipe cleaning device according to claim 1 wherein seal assemblies cooperate between said housing and said pipe to inhibit aggress of material from said housing.

10. A pipe cleaning device according to claim 9 wherein said seal assemblies include inflatable sealing members to engage said pipe.

11. A pipe cleaning device according to claim 10 wherein said seal assemblies include brushes to engage said pipe.

12. A pipe cleaning device according to claim 9 wherein said housing is separable along a plane containing the axis of said pipe and a seal assembly is associated with each portion of said housing.

* * * * *